US006403189B1

(12) United States Patent
Donahue

(10) Patent No.: US 6,403,189 B1
(45) **Date of Patent: *Jun. 11, 2002**

(54) UNITARY STACK OF REPOSITIONAL PAPER SHEETS

(75) Inventor: P. Richard Donahue, Naples, FL (US)

(73) Assignee: P. R. Donahue Incorporated, Naples, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/498,983

(22) Filed: Feb. 7, 2000

(51) Int. Cl.[7] ..... B42D 5/00

(52) U.S. Cl. ..... 428/40.1; 24/67 R; 24/67 AR; 281/21.1; 412/37; 412/38; 412/901; 428/40.2; 428/41.8; 428/42.1; 428/194; 428/211; 428/214; 428/354; 428/906

(58) Field of Search ..... 428/40.1, 41.8, 428/40.2, 42.1, 194, 211, 214, 354, 906; 281/21.1; 412/37, 38, 901; 24/67 R, 67 AR

(56) References Cited

U.S. PATENT DOCUMENTS

| | | | | |
|---|---|---|---|---|
| 2,030,135 A | | 2/1936 | Carpenter | |
| 2,647,849 A | | 8/1953 | Douglas et al. | |
| 3,464,842 A | | 9/1969 | Jackstadt | |
| 3,675,844 A | | 7/1972 | Sorrell | |
| 3,869,333 A | | 3/1975 | McMaster | |
| 4,379,012 A | | 4/1983 | Heymanns | |
| 4,582,737 A | | 4/1986 | Torgerson et al. | |
| 4,735,837 A | | 4/1988 | Miyasaka et al. | |
| 4,783,354 A | | 11/1988 | Fagan | |
| 4,950,517 A | | 8/1990 | Loggins | |
| 4,965,113 A | | 10/1990 | Jones et al. | |
| 5,202,169 A | | 4/1993 | Spendlove | |
| 5,300,171 A | * | 4/1994 | Braun | 156/249 |
| 5,401,547 A | | 3/1995 | Blackwell et al. | |
| 5,622,761 A | | 4/1997 | Cole | |
| 5,766,401 A | | 6/1998 | Campbell et al. | |
| 6,248,414 B1 | * | 6/2001 | Donahue | 428/41.8 |

* cited by examiner

*Primary Examiner*—Nasser Ahmad
(74) *Attorney, Agent, or Firm*—Charles R. Wilson

(57) ABSTRACT

A unitary stack of paper sheets has alternating individual paper sheets and double release liners which are releasably bonded together in a manner whereby an individual paper sheet is easily removed and used as a base. Each paper sheet in the unitary stack has a pressure sensitive adhesive partially covering each face thereof in approximate aligned areas of the respective faces. In use, an individual paper sheet is readily removed from the unitary stack and one or more release liners removed from the individual sheet to fully expose the front face and the back face of the individual sheet. The front face or the back face of the individual sheet is then adhered to the substrate, and an item posted on its opposed face.

24 Claims, 3 Drawing Sheets

UNITARY STACK OF REPOSITIONAL PAPER SHEETS

FIELD OF THE INVENTION

This invention relates to a unitary stack of repositional individual paper sheets. More particularly, the invention relates to a unitary stack of paper sheets in pad form which can be manufactured economically.

BACKGROUND OF THE INVENTION

Many people are in the habit of posting notes, appointment cards, children's artwork, messages, grocery lists, emergency telephone numbers, invitations and other informational-type items in a central home or office location. Bulletin boards, of course, have long been used for posting items. Thumb tacks or some needle-like tipped implement is used to hold the items, normally printed paper items, to the bulletin board. The homeowner may use a refrigerator door or other appliance with a large metallic surface area for temporarily holding the items. Thin magnets, commonly referred to as refrigerator magnets, are widely used. Adhesive tape can also be used to tape edges or corners of the item to the substrate. A double sided tape is also occasionally used. Such means of posting an item for later referencing are convenient, though can be somewhat cumbersome to use.

A substantial number of homes do not have a bulletin board for posting purposes or a kitchen appliance with a metallic substrate. In fact, many modern appliances have non-metallic surface panels which do not interact with magnets. Posting of light-weight items is more difficult in such homes. Articles produced to fill the known need include mark and wipe boards and dry erase boards.

Even in those homes that do already have a fixed location posting surface such as a bulletin board, there is occasionally a need to post an item in some other location. For example, the homeowner may want to post an item on a door surface for the attention of a delivery person or service person. Perhaps the homeowner may want to temporarily post an item on a door or windshield of a car parked in the garage, e.g. a letter to be mailed. Numerous other examples of practical posting uses for everyday living exist.

In accord with a need, there has been developed a unitary stack of paper sheets, each sheet of which can be used to form a base for adhering an item thereto. The unitary stack of paper sheets include double release liners between each paper sheet to facilitate the unitary stack's manufacturing and assembly in an economical fashion. The unitary stack is economical to produce, its use is easily understood, and the individual paper sheets are reliable for their intended purpose.

SUMMARY OF THE INVENTION

A unitary stack of paper sheets has sheets releasably bonded together in a manner whereby the stack maintains its integrity during storage and use, yet permits each individual paper sheet in the stack to be readily removed. The stack is in pad form and comprises alternating paper sheets and double release liners. Each paper sheet has a front face and a back face. A pressure sensitive adhesive partially covers each face of each individual sheet in approximate aligned areas thereof. The pressure sensitive adhesive on the front face or the back face of the paper sheet allows the paper sheet to be adhered to a substrate. The pressure sensitive adhesive on the opposed face of the paper sheet is to receive and hold an item for posting. An adhesive-free area on each individual sheet near one edge of the unitary stack is utilized for grasping by the user. The release liners facilitate removal of the individual paper sheets from the unitary stack. They also facilitate high speed manufacturing and assembly of the unitary stack.

DETAILED DESCRIPTION OF THE INVENTION

The unitary stack of individual paper sheets of the invention is particularly useful in a home setting and in an office setting. It is, for this reason, described in these settings in the following paragraphs. It can as well be used in an industrial setting or wherever there is a need to temporarily post a light-weight item for referencing purposes.

Figure 1:
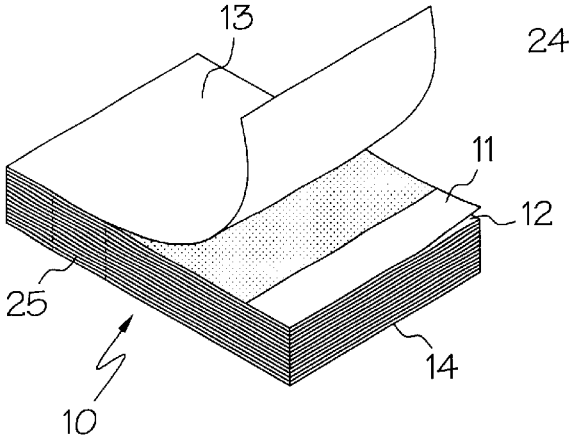
FIG. 1 is a perspective view of the unitary stack of paper sheets of the invention with a top release cover partially peeled back to reveal an uppermost individual paper sheet.
Figure 7:
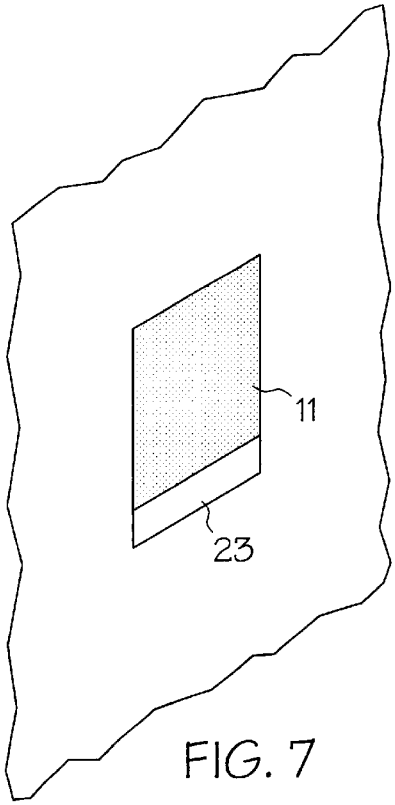
FIG. 7 is an environmental view of an individual paper sheet of the unitary stack of FIG. 1 adhered to a substantially vertical wall substrate.
Figure 8:
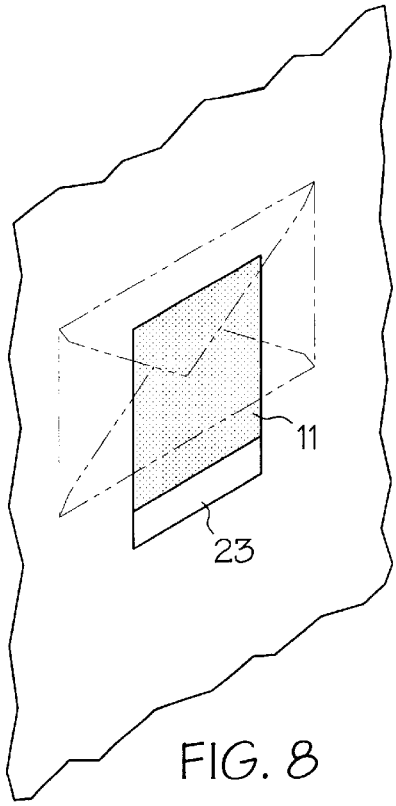
FIG. 8 is an environmental view of the individual paper sheet of FIG. 7 with an envelope temporarily adhered thereto for posting purposes.
Figure 9:
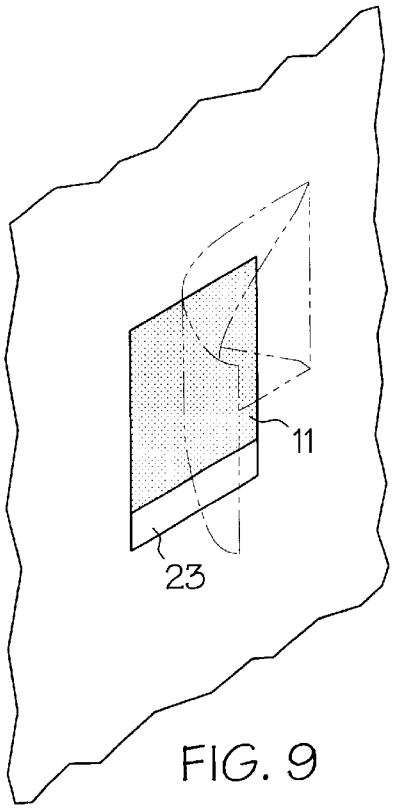
FIG. 9 is an environmental view of the individual paper sheet of FIG. 8 showing the envelope being removed with the paper sheet remaining on the wall substrate for reuse.

FIG. 1 shows the unitary stack of several individual paper sheets, while FIGS. 7–9 show a use of an individual paper sheet taken from the unitary stack. First, with reference to FIG. 1, there is shown a unitary stack 10 of the invention in a pad form. The stack 10 is comprised of a plurality of individual uniformly shaped paper sheets 11 and double release liners 12 releasably bonded together sufficiently to maintain the integrity of the stack. Collectively, they form a pad having a set of flat side edges. A removable top release cover 13 and a removable bottom release cover 14 are included on top and bottom respectively of the stack for packing reasons. The top release cover 13 is removed and discarded when the unitary stack 10 is initially used. The bottom release cover 14 normally remains in place until the unitary stack is depleted of its individual paper sheets. The individual paper sheets 11, release liners 12 and removal release covers 13 and 14 in the unitary stack are discussed in more detail in the following paragraphs.

The size and shape of the individual sheets 11 are not critical, though they are substantially equally sized. For manufacturing and packaging purposes, the individual sheets and hence the unitary stack is preferably rectangular-shaped or square-shaped. Each paper sheet 11 ranges from about one-fourth inch to about six inches in width and about one inch to about five inches in length. A preferred paper sheet ranges from about one-fourth inch to about one and one-half inch in width and about one inch to about three inches in length. The narrow width of the preferred paper sheet is feasible because of the adhesive used in the invention. Paper sheets with the narrow width are preferred due to reduced manufacturing costs, enhanced ease of use by the consumer, and desired inconspicuous product use. Larger sized paper sheets are feasible dependent on the intended use and are contemplated in this invention. Such larger sized paper sheets, though, tend to be for very specialized uses as found in an industrial setting.

Figure 3:
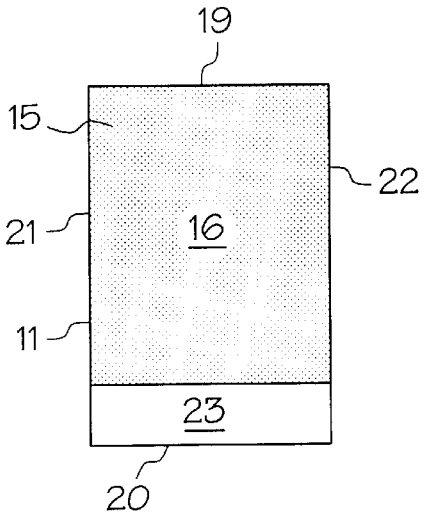
FIG. 3 is a top plan view of an individual paper sheet taken from the unitary stack of FIG. 1.
Figure 4:
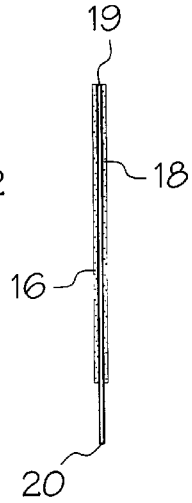
FIG. 4 is an side view of the individual paper sheet of FIG. 3.
Figure 5:
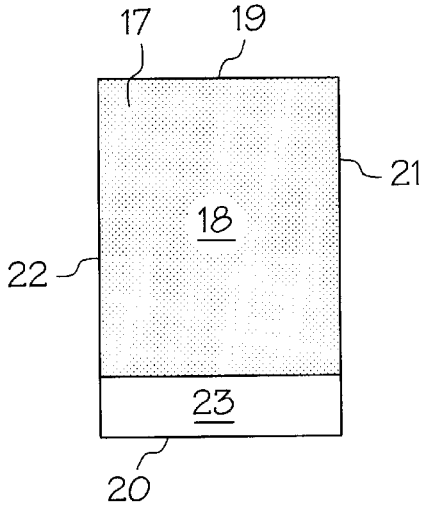
FIG. 5 is a bottom plan view of the individual paper sheet of FIG. 3.

Each paper sheet 11 in the unitary stack 10 has opposed adhesive-bearing surfaces. As best seen in FIGS. 3–5, an individual paper sheet 11 taken from the unitary stack 10 has a front face 15 with an adhesive 16 covering a portion of it and a back face 17, also with an adhesive 18 covering a portion of it. The front face 15 and the back face 17 are facing in opposite directions. There is a top edge 19, a bottom edge 20 spaced from the top edge and a pair of laterally spaced side edges 21 and 22 extending between the top and bottom edges.

Figure 2:
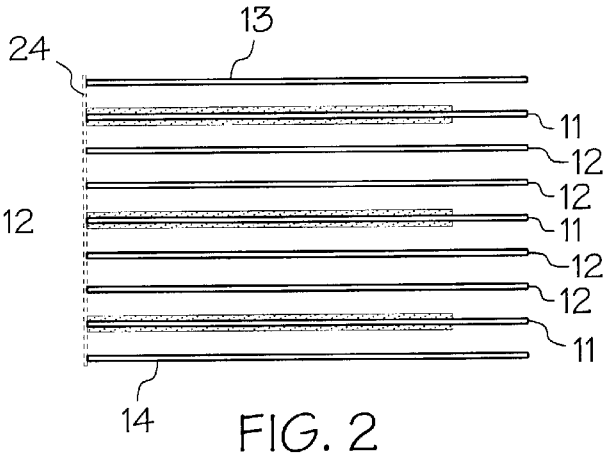
FIG. 2 is an exploded side view of the unitary stack of paper sheets of FIG. 1 showing the uppermost paper sheet, a lowermost paper sheet, an intermediate paper sheet, and double release liners.

The adhesives 16 and 18 on the individual paper sheets 11 partially cover the respective front face 15 and back face 17 and are firmly adhered thereto. The adhesives are depicted in FIGS. 2 and 4 as defined layers, though it should be understood the layers may have varying thicknesses and continuity throughout. It is important for the adhesive to not fully cover the faces in that the individual sheets are then more difficult to grasp and to remove from the stack during use. The adhesives 16 and 18 are positioned on approximate aligned areas of the respective faces of the paper sheets 11.

Preferably, each adhesive on the paper sheets extends fully across the width of the faces, from side edge 21 to side edge 22. Preferably, each adhesive also extends continuously down from the top edge 19 to about 70% to about 95% of the sheet's length, more preferably from about 80% to about 90% of the sheet's length to terminate inwardly of the bottom edge 20. A termination line is created which is substantially parallel with the bottom edge. An adhesive-free area 23 of about one-quarter inch to about three-quarters inch at the bottom of the sheet on both sides is created as a handle for grasping purposes. It has been found the preferred adhesive placement optimizes removal of individual sheets from the unitary stack and actual use of the individual sheets. Paper sheets which are fully covered on both sides by an adhesive are difficult to individually grasp and remove from the unitary stack. Conversely, too small of an adhesive area will adversely affect the ability of the individual sheet to adhere to a substrate and/or to adequately hold an item to be posted.

The adhesive must have a degree of adhesion sufficient to stick to a substrate and an item to be posted, yet be releasable. Additionally, the adhesive must not leave a sticky residue. Pressure sensitive adhesives are commercially available and ideally suited herein. Highly preferred are hot melt adhesives and water-based acrylic adhesives which are applied as microspheres onto the paper sheets. The adhesive is applied at a level to give a dried adhesive of from about 0.4 mil to about 0.8 mil, preferably about 0.6 mil in thickness. Application of the adhesive as microspheres on properly sized paper is done by conventional well known methods.

The acrylic adhesive when applied as microspheres and at the proper thickness results in a degree of adhesion of from about 100 grams to about 150 grams per linear inch, preferably about 125 grams to about 135 grams per linear inch using test criteria published by the Pressure Sensitive Test Council (PSTC-1). It is theorized that the proper degree of adhesion results from the form of the adhesive, i.e. microspheres as opposed to a coalesced film, and proper thickness of adhesive, i.e. about 0.4 mils to about 0.8 mils.

The number of individual paper sheets in a stack can vary widely. For practical purposes, each unitary stack has at least about three individual paper sheets. Preferably, from about 10 paper sheets to about 100 paper sheets form a unitary stack.

The unitary stack 10 also includes the double release liners 12 between each of the paper sheets 11. The release liners aid in removal of a single paper sheet 11 from the stack 10. Preferably, for appearance and performance purposes, each release liner 12 is approximately the same size and shape as the paper sheets 11. As evident in FIG. 2, when the release liner 12 is the same size as the paper sheet 11, a free edge on each release liner 12 is available for grasping and facilitates removal of an individual paper sheet.

As evident in FIG. 2, there are two release liners 12 between each paper sheet 11. The two release liners facilitate manufacturing of the unitary stack 10 and also facilitate use of the unitary stack. The product of the invention because of its manner of use primarily by individuals must be inexpensive. This requires that the manufacturing process must be fast and highly automated. Release liners on each side of an individual adhesive bearing sheet allows that sheet to be readily cut from larger sheets without sticking to the cutting equipment. Assembly to the stack form of the individually cut sheets with release liners on both sides is also greatly facilitated.

Figure 6:
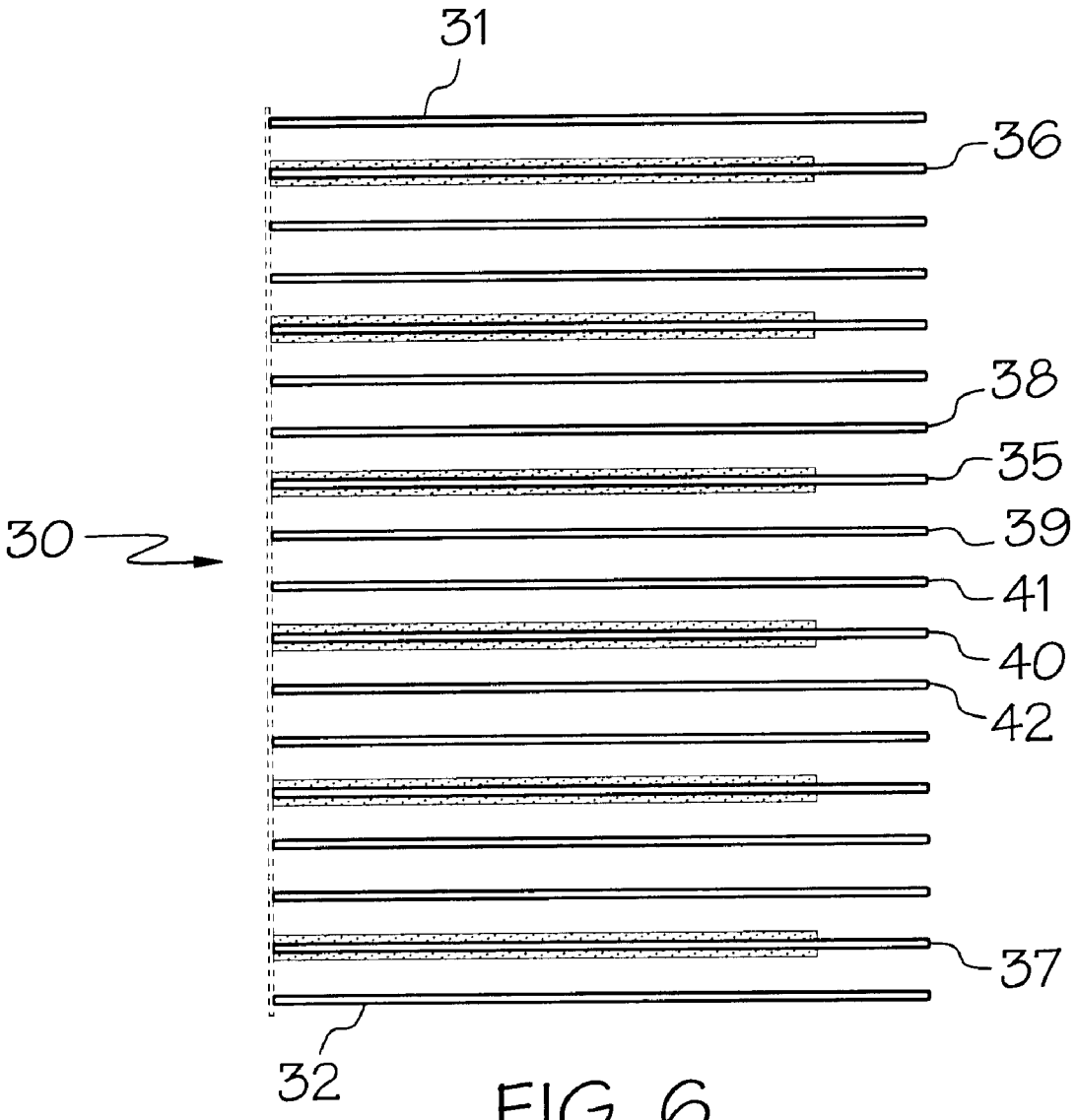
FIG. 6 is an exploded side view of another unitary stack of the invention showing multiple intermediate paper sheets and double release liners.

More particularly, and with reference to FIG. 6, a unitary stack 30 has a top release cover 31, a bottom release cover 32 and multiple intermediate paper sheets therebetween. Each of the individual paper sheets is as described above with reference to FIGS. 1–5. A first intermediate paper sheet 35 positioned between the uppermost paper sheet 36 and the lowermost paper sheet 37 carries a first upper release liner 38 in overlying relationship with the front face layer of pressure-sensitive adhesive and releasably adhered thereto. Also, there is a first lower release liner 39 in underlying relationship with the back face layer of pressure-sensitive adhesive and releasably adhered thereto. Similarly, a second intermediate paper sheet 40 has a front face layer of pressure-sensitive adhesive with an overlying second upper release liner 41 and a back face layer of pressure-sensitive adhesive with an underlying second lower release liner 42.

As readily apparent in FIG. 6, there are two release liners positioned between each intermediate paper sheet. There are also two release liners between an intermediate paper sheet that is adjacent the uppermost paper sheet and two release liners between an intermediate paper sheet that is adjacent the lowermost paper sheet of the stack. The double release liners throughout the unitary stack allow a user to initially peel from the stack the top release cover 31 and then to selectively peel from the stack either a paper sheet devoid of release liners or a paper sheet having one or more release liners releasably attached thereto.

Release liners of various natures are commercially available and are used in the invention. For example, the release liners can be a wax coated paper sheet, silicone-coated paper sheet, or a plastic sheet such as a polyethylene terephthalate (available as Mylar sheet) or any other plastic sheet made from synthetic polymeric resin with non-stick physical characteristics. Highly preferred release liners are made from supercalendered kraft paper which has been silicone coated on both sides.

The removable release covers 13 and 14 are releasably attached to individual paper sheets 11. The top release cover 13 is releasably attached to an uppermost paper sheet through the front face adhesive on the uppermost paper sheet. The top release cover has a size and a shape to completely cover the upper layer of pressure-sensitive adhesive on the uppermost sheet and to extend at least partially, preferably fully, over the adhesive-free area of the front face of the uppermost sheet. The bottom release cover 14 is releasably attached, through the adhesive of the back face of the lowermost paper sheet. The bottom release cover 14 has a size and shape substantially equal to that of the individual paper sheets.

A binding material 24 is used to hold the individual sheets in pad form to define the unitary stack. In known fashion, the binding material is applied at least to a side of the stack opposed from the free edges of the individual sheets. Top edges of the individual paper sheets are effectively connected together by the binding material. The binding material is such that each individual sheet is readily pulled loose from the stack with a minimum of force. Preferably, a binding material is also applied to one or two full or partial sides of the stack so that side edges of the individual sheets at right angles to the top edges are connected together. With reference to FIG. 1, the binding material on one or two sides is most preferably applied as a partial vertical band 25 along the side, i.e. about one inch to about two inches in width. The added binding material in this preferred embodiment helps to maintain the individual sheets of the unitary stack in registry during storage.

In use, the home owner or office worker who desires to post an item simply grasps an individual paper sheet from the unitary stack and pulls it therefrom. As seen in FIGS. 6–8, the sheet is then placed on a substrate in a convenient location. Either the front face or the back face of the sheet can be placed in contact with the substrate. It can be used as is by writing on it. In accord with the primary focus of the invention, an item such as an envelope to be posted is placed in contact with the adhesive on the face of the paper sheet which is exposed. It remains there for an indefinite time. In due course, the individual removes the item and reuses the paper sheet or simply removes and discards it. Whenever another paper sheet is needed, the home owner of office worker simply removes and discards the release liner underlying the first paper sheet to expose the next paper sheet. That paper sheet is removed from the stack and used as described above with respect to the first paper sheet.

The unitary stack of paper sheets of the invention can be modified in various manners for specialized users. For example, the degree of adhesion of the adhesive on the back face can be greater than the degree of adhesion on the front face of each individual sheet to better ensure that removal of a posted item from a sheet adhered to a surface will leave the sheet in place. Also, the adhesive-free areas of each sheet can be sufficiently large to receive penciled or penned notes. Still other features to enhance the stack's marketing appeal are feasible, e.g. color-coded sheets, etc.

Having described the invention in its preferred embodiment, it should be clear that modifications can be made without departing from the spirit of the invention. It is not intended that the words used to describe the invention nor the drawings illustrating the same be limiting on the invention. It is intended that the invention only be limited by the scope of the appended claims.

I claim:

1. A unitary stack of alternating paper sheets and double release liners releasably bonded together in a manner to maintain the integrity of the stack and to individually readily remove each paper sheet from the stack for adhering to a substrate so as to provide a base for temporarily posting an item, said unitary stack comprising:

(a) a set of individual repositional paper sheets in registry with one another, each said paper sheet having a front face and a back face with a pressure sensitive adhesive partially covering each said face in approximate aligned areas of the respective faces to create an adhesive-free area on said front face and said back face extending from one edge of the paper sheet for grasping; and (b) double release liners between each of the individual paper sheets, each said release liner adjacent one individual paper sheet and adjacent the other of said double release liners and further each of said double release liners being a double-sided silicone coated paper sheet, whereby each individual repositional paper sheet is available for ready grasping, removing from the stack, and adhering to the substrate.

2. The unitary stack of claim 1 wherein each paper sheet in the stack ranges from about one-fourth inch to about six inches in width and about one inch to about five inches in length.

3. The unitary stack of claim 2 wherein each paper sheet in the stack ranges from about one-fourth inch to about one and one-half inch in width and about one inch to about three inches in length.

4. The unitary stack of claim 2 wherein each paper sheet in the stack is rectangular-shaped.

5. The unitary stack of claim 2 wherein each paper sheet in the stack has the pressure sensitive adhesive extending substantially fully across the width of the sheet on the front face and on the back face thereof.

6. The unitary stack of claim 5 wherein the adhesives extend from a top edge of the paper sheet to about 70% to about 95% the length of the paper sheet.

7. The unitary stack of claim 6 wherein the adhesive is an acrylic adhesive in the form of microspheres.

8. The unitary stack of claim 6 wherein the adhesive is a hot melt adhesive.

9. The unitary stack of claim 8 wherein the stack contains at least about three paper sheets.

10. The unitary stack of claim 9 wherein the stack contains from about 10 paper sheets to about 100 paper sheets.

11. A unitary stack of individual uniformly shaped paper sheets and double release liners releasably held together so as to maintain the integrity of the stack yet allow each individual sheet thereof to be readily removed therefrom to adhere to a substrate for temporarily posting an item thereon, said unitary stack comprising:

(a) at least 10 individual repositional paper sheets, each said paper sheet ranging from about one-fourth inch to about one and one-half inch in width and about one inch to about three inches in length and having a front face and a back face with said front face and said back face having (i) an adhesive area extending from a top edge of the sheet covered with from about 0.4 mils to about 0.8 mils of a pressure sensitive acrylic adhesive in the form of microspheres and (ii) an adhesive-free area extending from a bottom edge of the paper sheet to the adhesive area such that each said adhesive area is in approximate aligned areas of the respective faces and each said adhesive-free area is in approximate aligned areas of the respective faces;

(b) a set of double release liners having non-stick surfaces with each of said double release liners in the set being positioned between two individual paper sheets so that said paper sheets are never in contact with one another, each of said release liners having substantially the same shape and size as the individual paper sheets; and (c) a binding material connected at least with each top edge of the paper sheets and connected to side edges of the paper sheets for holding the paper sheets in registry, whereby each individual repositional paper sheet can be readily grasped for removal from the stack and adhered to the substrate.

12. The unitary stack of claim 11 wherein each of the adhesives on each paper sheet extends from a top of the paper sheet to about 70% to about 95% the length of the paper sheet.

13. The unitary stack of claim 12 further comprising a top release cover and a bottom release cover.

14. A unitary stack of paper sheets in pad form, each paper sheet having opposed, adhesive-bearing surfaces for releasably attaching an item to a surface, said stack comprising:

(a) a plurality of substantially equally-sized paper sheets including an uppermost paper sheet, a lowermost paper sheet and intermediate paper sheets, each paper sheet having a front face and a back face facing in a direction opposite from the front face, a top edge, a bottom edge spaced from the top edge, and a pair of laterally spaced side edges extending between the top and bottom edges, wherein the paper sheets are positioned in face-to-back relationship with each other, further each paper sheet having a front face layer of pressure-sensitive adhesive firmly attached to and covering a portion of the front face of the sheet, and a back face layer of pressure-sensitive adhesive firmly attached to and covering a portion of the back face of the sheet, wherein each of the pressure-sensitive adhesive layers extends continuously from the top edge of the sheet on each of the front and back faces to a position between the top and bottom edges of the sheet so that each of the front and back areas of the sheet includes free areas that are devoid of adhesive to facilitate gripping of a sheet for removal from the pad, further the adhesive layers each extending continuously between the side edges of the sheet to define on each face of the sheet an area that is completely covered with adhesive and an area that is free of adhesive;

(b) a bottom release cover to which the lowermost paper sheet is releasably attached by connection of the back face layer of adhesive of the lowermost paper sheet with the bottom release cover, the bottom release cover having a size and shape that is substantially equal to that of the paper sheets;

(c) a top release cover to which the uppermost paper sheet is releasably attached by connection of the front face layer of adhesive of the uppermost paper sheet with the top release cover, the top release cover having a size and shape to completely cover the front face layer of pressure sensitive adhesive of the uppermost paper sheet and to extend at least partially over the free area of the front face of the uppermost paper sheet;

(d) a set of double-sided silicone coated paper sheet release liners, wherein each intermediate paper sheet positioned between the uppermost paper sheet and the lowermost paper sheet carries an upper release liner in overlying relationship with the front face layer of pressure-sensitive adhesive and releasably adhered thereto, and a lower release liner in underlying relationship with the back face layer of pressure-sensitive adhesive and releasably adhered thereto, so that two release sheets are positioned between each intermediate paper sheet and between intermediate paper sheets that are adjacent the uppermost paper sheet and the lowermost paper sheet of the stack, to allow a user to initially peel from the stack the top release cover and then to selectively peel from the stack either a paper sheet devoid of release liners or a paper sheet having one or more release liners releasably attached thereto; and (e) a binding material connected at least with each of the top edges of the paper sheets to hold the paper sheets in pad form to define a unitary stack of paper sheets.

15. The unitary stack of paper sheets in pad form of claim 14, wherein the paper sheet and the release liners are of equal size and shape to define a pad having a plurality of flat edges.

16. The unitary stack of paper sheets in pad form of claim 14, wherein the paper sheets and the release liners are each rectangular.

17. The unitary stack of paper sheets in pad form of claim 14, wherein the front face layer of adhesive of each paper sheet covers from about 70% to about 95% of the total area of the front faces of the paper sheets.

18. The unitary stack of paper sheets in pad form of claim 14, wherein the back face layer of adhesive of each paper sheet covers from about 70% to about 95% of the total area of the back faces of the paper sheets.

19. The unitary stack of paper sheets in pad form of claim 14, wherein each of the front face and back face layers of adhesive cover from about 80% to about 90% of the total areas of each of the front and back faces of the paper sheets.

20. The unitary stack of paper sheets in pad form of claim 14, wherein the stack of sheets is defined by a plurality of paper sheets and the release sheets in which adjacent sheets are disposed in front-face to back-face relationship with respective top, bottom, and side edges of adjacent sheets in registry with each other.

21. The unitary stack of paper sheets in pad form of claim 14, wherein the binding material is further connected at least with a top edge of each of the release sheets to hold the paper sheets and the release sheets in pad form.

22. The unitary stack of paper sheets of claim 21 further wherein the binding material is connected to the side edges of the individual paper sheets on at least one side of the unitary stack for holding the individual sheets in registry.

23. The unitary stack of paper sheets in pad form of claim 14, wherein the areas of pressure-sensitive adhesive each terminate inwardly of the bottom edges of the paper sheets to provide adhesive-free areas on each of the front and back faces of the paper sheets.

24. The unitary stack of paper sheets in pad form of claim 14, wherein the areas of pressure-sensitive adhesive each terminate in a line that extends across the paper sheet between the side edges and that is substantially parallel with the bottom edge of the paper sheet.

* * * * *